US006327883B1

(12) United States Patent
Noé et al.

(10) Patent No.: US 6,327,883 B1
(45) Date of Patent: Dec. 11, 2001

(54) METHOD OF FLATTENING METAL STRIP

(75) Inventors: Rolf Noé , Mulheim/Ruhr; Andreas Noé , Kerken; Stefan Sonntag, Duisburg, all of (DE)

(73) Assignee: BWG Bergwerk-Und Walzwerk-Maschinenbau GmbH, Duisburg (DE)

( * ) Notice: Subject to any disclaimer, the term of this patent is extended or adjusted under 35 U.S.C. 154(b) by 0 days.

(21) Appl. No.: 09/609,839

(22) Filed: Jul. 5, 2000

(30) Foreign Application Priority Data

Jul. 17, 1999 (DE) ..... 199 33 610

(51) Int. Cl.[7] ..... B21D 1/05

(52) U.S. Cl. ..... 72/8.5; 72/12.2; 72/200; 72/205; 72/161

(58) Field of Search ..... 72/205, 200, 161, 72/164, 8.5, 11.3, 12.2

(56) References Cited

U.S. PATENT DOCUMENTS 4,033,165 * 7/1977 Arimura ..... 72/161
4,765,169 * 8/1988 Bradlee ..... 72/160

FOREIGN PATENT DOCUMENTS 27 43 130 6/1978 (DE) .

* cited by examiner

*Primary Examiner*—Daniel C. Crane
(74) *Attorney, Agent, or Firm*—Herbert Dubno

(57) ABSTRACT

Strip tension in metal strip subjected to a plastic deformation such as skin or dressing rolling, stretch bend leveling or stretching is adjusted by local variation of the temperature to establish a temperature profile which minimizes waviness and camber in metal strip.

7 Claims, 6 Drawing Sheets

METHOD OF FLATTENING METAL STRIP

FIELD OF THE INVENTION

Our present invention relates to a method of flattening metal strip and, in particular, eliminating waviness and camber in the rolling (skin-pass rolling) and/or leveling (stretch-bend leveling) or tension leveling or stretching of a metal strip under tension.

BACKGROUND OF THE INVENTION

In metal strip lines in which tension is applied to the metal strip and processing is carried out which involves a certain plastic deformation of the metal strip, waviness and strip camber can arise. The waviness is usually found along the longitudinal edges of the strip and the camber can affect the entire width of the strip. The processing under tension with which the invention is concerned can include cold rolling and dressing rolling (skin-pass rolling) of the strip. The dressing rolling can impart the final thickness to the strip and is distinguished from the cold rolling by the fact that it affects only a relatively small reduction of the strip thickness. Dressing or skin-pass rolling is often referred to also as after-rolling or calibration rolling.

Leveling, as this term is used here, usually means the bending of the strip back and forth, commonly by passage through an array of rollers. A typical leveler has four or more rolls and the strip is bent from side to side as it passes into successive contact with the rolls. Since the strip is under tension, such leveling is also referred to as stretch-bend leveling. The invention is also applicable to processing which involves stretching of the strip, i.e. elongation of the strip under the applied tension. The tension can be applied between bridles, the upstream bridle being driven at a peripheral speed which is greater than that of the downstream bridle. The downstream bridle may be braked to generate the tension while the upstream bridle is driven. The term "flattening" as used herein, is intended to refer to reduction in the waviness or camber of the strip or complete elimination thereof. In addition it should be understood that, while the invention is primarily of interest in the processing of strip, it is also applicable to the flattening of sheets and plates of metal.

In practice it has been found heretofore that it is impossible to completely eliminate the waviness or strip camber which develops in metal strip even through the metal strip is subjected under tension to rolling, leveling and/or stretching in the manner described. As a result, an ideal flat strip can be seldom achieved. The term "ideal planarity" means, within the context of the invention, that all longitudinal segments of the strip are of equal length across the width of the strip when the strip is not under load, i.e. the applied tension is removed, and the temperature in the strip is constant. The strip, although a single piece can be viewed as having a multiplicity of adjoining longitudinal zones or segments which collectively make up the full width of the strip and in the case of temperature inhomogeneity may be at different temperatures and may even have different thicknesses and stresses. There are no strict boundaries between such zones and reference to them is not intended to indicate that the zones are either well developed laterally or distinguishable from one another except by the parameter which differentiates them, like temperature.

Generally the nonflatnesses which characterizes metal strip may result in part from residual bending moments which can give rise to curvature in the longitudinal and/or transverse direction, referred to as coilset or crossbow. The invention is not intended to deal with these contributions to the nonplanarity of the strip or with secondary effects which arise because of nonuniform distributions of transverse stress in the strip plane. The invention is intended, however, to deal with the waviness or camber which can result from the effective length differences of longitudinal zones of the strip.

Residual waviness after cold rolling can amount typically to up to 100 I units, after dressing or after-rolling up to 30 I units and after leveling to up to 10 I units. The I unit corresponds to a length difference between two strip zones in the metal strip of 10 $\mu$m/m. The planarity can be measured, for example, off line, on a planarity measuring rollers which can signal the effective length differences of the respective longitudinal zones as strip travels past such rollers. In modern rolling technology with control units to improve the planarity for example by roll-bending or axial shifting of the rolling rolls, the planarity of the strip can be greatly improved by comparison to strip produced prior to the advent of such system. Nevertheless an ideal planarity or even an approximately ideal planarity has not, however, been attainable heretofore.

In the rolling of metal strip which has been proposed to improve the planarity by changing the rolling gap geometry over the width of the rolls and to influence the temperature distribution by providing a multiplicity of heating elements in the rolling region, it has also been suggested to supply thermal energy to the metal strip itself so that in thicker longitudinal zones of the metal strip, thermal expansion will be promoted or the elongation of the strip increased over cooler longitudinal zones during the rolling process (see DE 27 43 130). These systems do not however eliminate waviness and strip camber as described.

OBJECTS OF THE INVENTION

It is the principal object of the present invention to provide an improved method of processing metal strip and particularly eliminating or reducing waviness or camber in metal strip during the rolling, leveling or stretching thereof whereby products of improved planarity can be obtained.

It is also an object of the invention to provide a method of reducing waviness and camber in metal strip which is more economical than earlier systems and can practically completely eliminate the waviness and camber.

A further object of the invention is to provide an improved strip processing method whereby drawbacks of earlier systems are obviated.

SUMMARY OF THE INVENTION

These objects and others which will become apparent hereinafter are attained, in accordance with the invention in a method for processing metal strip to increase the planarity thereof especially for eliminating waviness and camber during rolling, leveling or stretching of the metal strip and wherein the metal strip is subjected to tension during the rolling, leveling, and stretching, wherein the metal strip is plastically deformed by a predetermined amount with a variable degree of planarity across the width of the strip, the metal strip is zone-wise heated or cooled across the metal strip to produce a predetermined temperature profile varying the zone length across the strip and thus influencing the tension distribution across the width, and the degree of planarity is adjusted by varying the tension distribution.

According to the invention, therefore, the temperature profile prior to rolling and/or leveling and/or stretching of the strip is adjusted to vary the tension which develops in each of the longitudinal zones although the temperature profile can also be generated following the rolling and/or leveling and/or stretching of the strip.

More particularly, the invention is a method of processing metal strip to produce a product with limited waviness and camber, i.e. a method of producing flat metal strip or a method of leveling metal strip which comprises the steps of:

(a) applying tension to metal strip over a length thereof during travel of the metal strip along a processing line;

(b) subjecting the metal strip over the length and while under the tension to at least one plastic deformation operation selected from rolling, leveling and stretching with a degree of plastic deformation varying across a width of the metal strip;

(c) subjecting the metal strip within the length to zone-wise selective temperature modification at respective longitudinal zones across the width of the strip to establish a temperature distribution in the strip across the width and influence a tension distribution thereacross; and (d) adjusting the tension distribution by controlling the temperature distribution to maximize a degree of planarity imparted to the strip.

The invention is based upon the discovery that the zone-wise heating of the metal strip not only enables variation in the thickness of the metal strip because of the thermal expansion characteristic thereof but also contributes to a change in the tension distribution in the strip when tension is applied to the latter. Thus by a local heating at specific locations, the tension can be locally reduced. Since, however, there is a relationship between the degree of flatness (e.g. the dressing degree or the degree of stretch) and the tension, the degree of flattening or leveling over the strip width can be manipulated in a targeted manner.

While the invention is described in greater detail below in connection with dressing or skin pass rolling, it is equally applicable to the other plastic deformation operations, namely, stretch bend leveling and stretching, which have been described.

A metal strip which has waviness in which regions, e.g. resulting from a prior rolling operation, usually has increased plastic elongation in the edge regions while at the center of the strip, the plastic elongation is less or may even be nonexistent.

In the course of the skin pass rolling referred to as dressing rolling herein (and in the course of leveling, particularly stretch bend leveling and stretching, the strip is plastically deformed over the entire width of the strip, and, indeed, with a variable degree of dressing (ratio of thickness reduction in the skin pass rolling). Thus, for example at the center of the strip there is a greater plastic lengthening whereas in the edge regions, where the plastic elongation is greater, there is less or possible zero plastic lengthening. The difference between the plastic elongation in the edge regions and at the center diminishes as a result of the skin pass rolling so that the waviness is reduced. A constant plastic elongation over the entire strip width cannot, however be achieved because the degree of dressing cannot be optionally set by conventional means. This is the point at which the invention intervenes. If, for example, the edge region is heated to a higher temperature, i.e. is more strongly heated than the center of the strip, the tension in the edge region will decrease. The degree of dressing, however, increases at a constant rolling force with increasing tension. It thus will be seen that the degree of dressing in the heated edge region will be reduced directly by the local heating there. Correspondingly a distribution of the degree of dressing over the width of the strip can be produced which cannot be achieved exclusively by mechanical means. As a consequence, the waviness can be further reduced beyond what is possible by such mechanical means.

While the description below is based upon skin pass rolling, the plastic deformation operation can be a stretch bend leveling or stretching or any combination of the three since in these plastic deformation operations as well the plastic lengthening or degree of stretch depends upon the tension locally in effect.

According to the invention the temperature profile of step (c) can also be produced prior to the coiling of the metal strip or before and/or after the plastic deformation operation. Adjustment of the temperature profile before coiling is especially advantageous with metal strip from alloys with a tendency to creep and, for example, a positive thickness profile. When such strip is placed under tension, the tension is concentrated at the center of the strip. In the wound up coil, with conventional methods, there is increased tangential and radial stress which can exceed the creep limit. If the strip is then uncoiled some time later, it is found to be dished at the center. If the method of the invention is applied prior to coiling by heating the strip in the region of the center or cooling strips at the edges, the tensile stress at the center of the strip and thus the strip tension in the coil can be reduced.

According to a feature of the invention, the temperature distribution of the strip at the upstream and downstream sides of the plastic deformation operation are measured over the width of the strip. The temperature profile produced in the strip in step (c) is controlled or regulated as a function of the measured temperature distribution and in this manner the desired temperature distribution is maintained. The planarity of the strip can be further improved by this type of control. The temperature measurement can be a traversing temperature measurement with the temperature measuring instrument, for example, a pyrometer being traversed back and forth across the width of the strip.

The temperature control can use a setpoint/actual value method and the control of planarity can utilize temperature measurements taken close to the location at which planarity measurements are effected. One or more traversing parameters can be used and the planarity measurement can utilize measuring rollers as described or contactless systems.

According to a preferred feature of the invention, the temperature profile is rendered uniform following the rolling and/or leveling and/or stretching by zone-wise cooling or heating of the metal strip. Thereafter the flat strip can be coiled.

According to a further feature of the invention, where one or more rolls and/or rollers contact the metal strip, these rolls and/or rollers are heated or cooled to maintain the temperature at which rolls and/or rollers contact the strip constant. This prevents the rolls or rollers from imparting a nonhomogeneous temperature profile to the strip which could give rise to an altered roll gap geometry. Note should be taken that the point of the invention is that local heating of the metal strip is not intended to influence the roll gap geometry but rather, the heating or cooling locally is intended to vary the tension distribution in the strip itself and thus the degree of planarity imparted thereto in the rolling gap by the other plastic deformation operations described.

While the rolling or leveling can be effected without strip tension in the case of plates or sheets in which the mean tension is zero, tension is required for the practice of the invention even on these plates or sheets for the plastic deformation. The zone-wise heating of the metal strip is effected preferably in a contactless manner, i.e. inductively.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
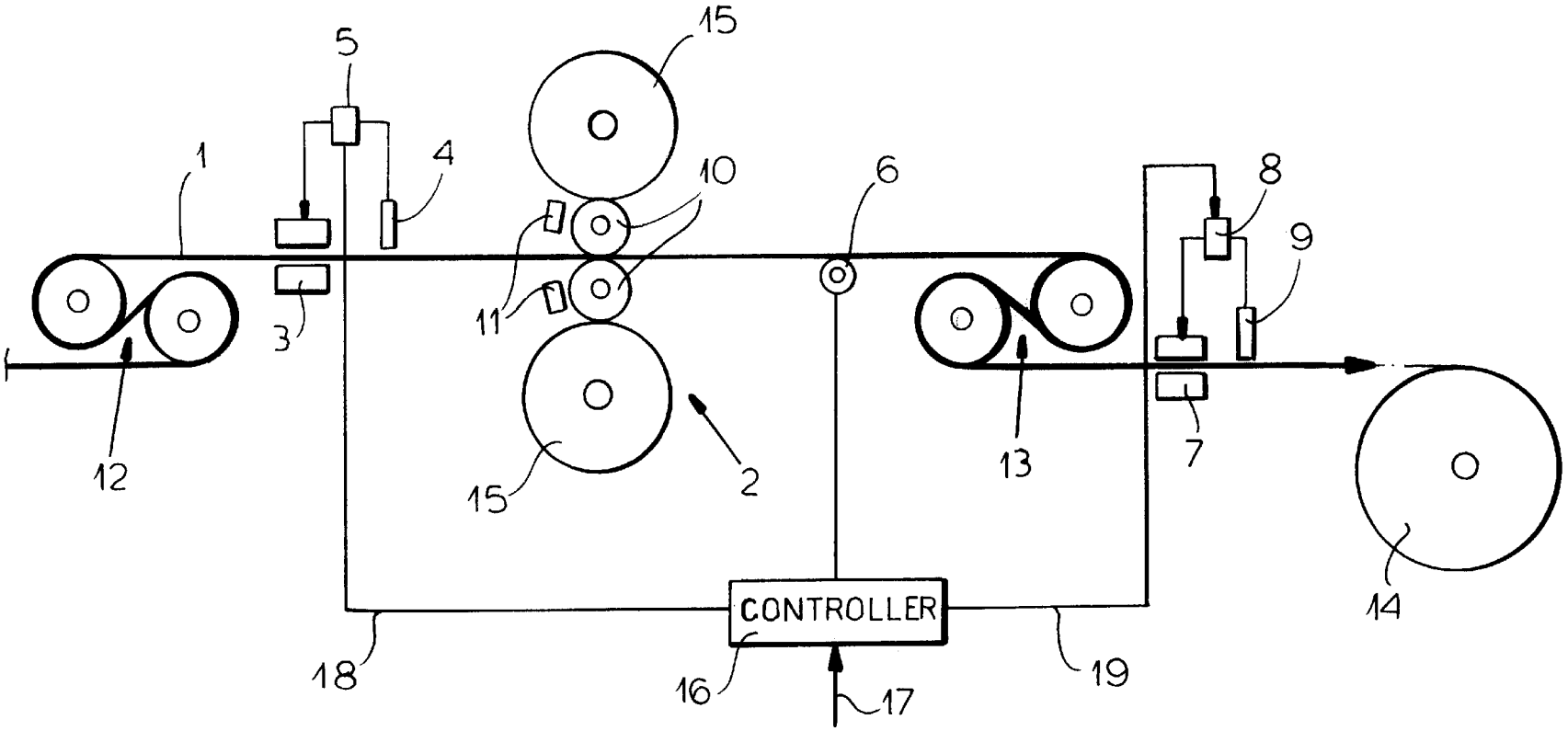
FIG. 1 is a diagram of a strip processing line provided with the requisite means for practicing the invention.

In FIG. 1*a* portion of a strip processing line is shown which includes the flattening stage of the present invention. The apparatus shown in FIG. 1 is intended to eliminate waviness and strip camber in the course of a dressing resulting of the strip under tension. In this case, the metal strip 1 is under tension between a pair of bristles 12 and 13, the latter being driven at a higher peripheral speed than the bristle 12 to apply tension continuously to the strip as it passes through the illustrated stretch, i.e. the dressing stretch of a strip processing line. Downstream of the bristle 13, a coiler 14 can be provided to take up the processed strip in a coil. Over this stretch, the metal strip is passed through a dressing mill 2 which comprises a pair of dressing rolls 10 and backup rolls 15 bearing on the dressing roll. The dressing operation is used to bring the strip to its final thickness prior to coiling and usually reduces the thickness by plastic deformation of the strip by a fraction of the reduction in thickness during the cold rolling or hot rolling of the strip. The dressing can reduce the thickness by from a fraction of a mm to several mm.

In passing through the dressing mill 2, the strip 1 is plastically deformed by a predetermined extent in the mill 2 which can be designed to vary the dressing degree, i.e. the percentage reduction in thickness across the width of the strip.

By zone-wise heating or cooling of the strip over its width, a temperature profile can be imparted to the strip, also over the width thereof which influences the tension distribution across the width. For this purpose a plurality of heaters 3 which are separately controllable and can independently heat respective zones of the strip to different temperatures, can be arrayed across the strip.

By varying the temperature profile and thus correspondingly varying the tension distribution across the width, it is possible to vary the degree of dressing.

From FIG. 1 it can be seen that the heating elements 3 are disposed at the inlet side to the mill 2 which effects the plastic deformation of the strip, i.e. that the temperature profile is set in the strip before the dressing rolling of the strip is effected. The heating can be effected inductively.

In addition, the temperature distribution within the metal strip is measured across the width of the latter at the inlet side of the dressing mill. Utilizing a controller 5 of the feedback type, the heating elements 3 can be controlled in response to the measured value of the temperature profile across the width to maintain a predetermined temperature profile. The temperature measuring device 4 which can sweep across the width of the strip is coupled to the controller 5 which, in turn, controls the heating elements 3. The temperature measuring unit 4 may be a traversing pyrometer. For the purpose of setpoint control, a level measuring system can be provided. That system is shown to comprise the level measuring roller 6 which may represent one of a plurality of rollers measuring length elements of respective longitudinal zones of the strip and providing an actual value signal for a controller 16 which can have a setpoint input 17 and can provide feedback at 18 to the arrangement 3, 4, 5 imparting the temperature profile to the strip 1 entering the dressing mill 2, or an output 19 to a downstream controller 8 described subsequently. The system 6, 16 17, 18, 19 provides setpoint/actual value control of the temperature profile in response to measured planarity.

Downstream of the present mill 2 by zone-wise cooling or heating the temperature profile can be matched. For this purpose, further heating elements 7 can be provided, likewise arrayed across the width of the strip and independently controlled by the controller 8 responding to the temperature-measuring unit 9.

Finally, FIG. 1 shows that further heating elements 11 can be provided in juxtaposition with the strip contacting rollers 10 to variably heat these rollers across the strip width. If desired cooling elements can be used at 11 to cool selected regions of the strip contacting rollers 10.

In the conventional flattening of metal strip which may have waviness along the longitudinal edges and camber, the strip has prior to rolling the waviness along the longitudinal edges which is characterized by a plastic elongation or yield which is greater than that in the center of the strip. This has been represented in FIG. 2 where the distribution of the relative plastic yield or elongation is greater at the edge regions of the strip than at the center thereof. The relative plastic yield $\Delta\epsilon_{p1.0}(y)$ is shown over the width B of the strip in FIG. 2 prior to rolling and is a result of the waviness along the edges.

Since the metal strip runs through the dressing mill 2 under tension, the total yield $\epsilon_{ges.0}(y)$ is the sum of the plastic yield $\Delta\epsilon_{p1.0}(y)$ and the elastic yield $\epsilon_{e1.0}$.

Figure 3:
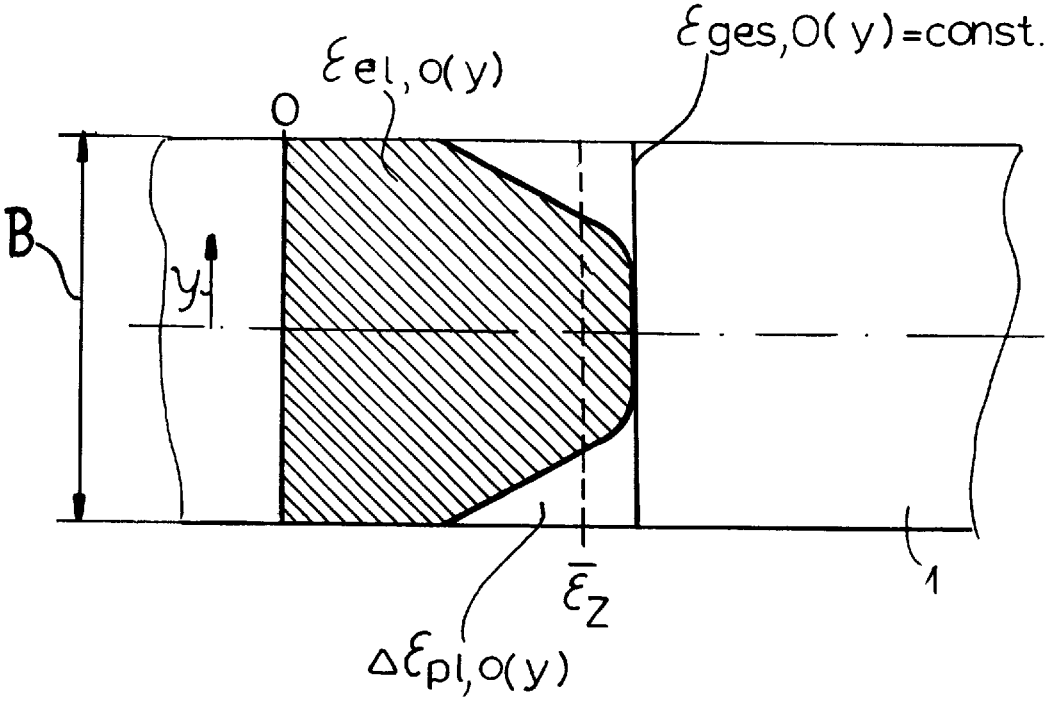

The tension is maintained sufficiently high that all of the longitudinal zones or strips of the band are under tension and the total yield or elongation $\epsilon_{ges.0}(y)$ is constant over the strip width. Thus the distribution of the elastic yield $\epsilon_{e1.0}(y)$ is given across the strip width directly from the distribution of the plastic yield $\Delta\epsilon_{p1.0}(y)$, compare FIG. 3. The mean elongation under tension $\bar{\epsilon}_z$ in the metal strip is given by the tension $F_z$, the width B of the strip and the thickness S thereof as $$\bar{\epsilon}_z=\bar{\sigma}_z/E=F_z/(B\cdot S\cdot E\cdot),$$

where E is the modulus of elasticity.

When the metal strip then runs into the dresser mill, the strip is plastically deformed by the dressing rolls 10 over the entire width of the strip in accordance with the degree of dressing represented at $\epsilon_D(y)$.

Figure 4:
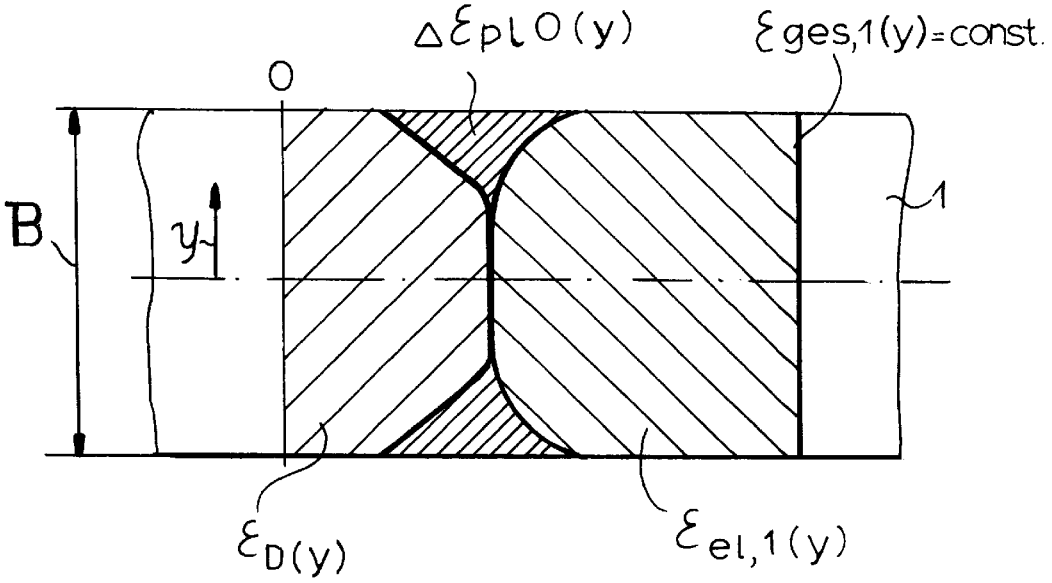
FIGS. 4 and 5 are graphic representations of the yield distributions in a metal strip for a constant strip temperature across the width after the rolling.

The distribution of the degree of dressing $E_D(y)$ is represented in FIG. 4. FIG. 4 also shows the original plastic yield $\Delta\epsilon_{p1.0}(y)$. The strip remains under tension before and after rolling and the total yield is thus constant $\epsilon_{ges.1}(y)$ where:

$$\epsilon_{ges.1}(y)=\epsilon_D(y)+\Delta\epsilon_{p1.0}(y)+\epsilon_{e1.1}(y)=\text{const.}$$

Because of the plastic lengthening during the dressing, there is a change in the plastic yield $\Delta\epsilon_{p1.1}(y)$ which directly results in a new distribution of the elastic yield $\Delta\epsilon_{e1.1}(y)$.

FIG. 4 shows that during the dressing with the degree of dressing $\epsilon_D(y)$ there is greater elongation at the center of the strip than at the edges. The result is a new plastic yield $\Delta\epsilon_{p1.1}(y)$ with a flatter course over the width of the strip than the original distribution of the plastic yield $\Delta\epsilon_{p1.0}(y)$.

Figure 2:
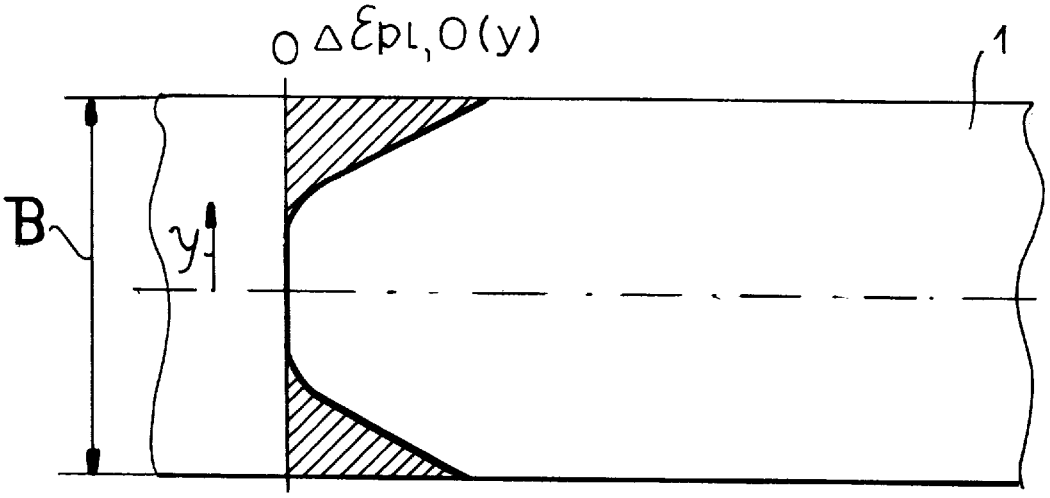
FIGS. 2 and 3 are graphic representations of the yield or elongation distributions in the metal strip for a constant strip temperature across the strip width prior to the rolling.
Figure 5:
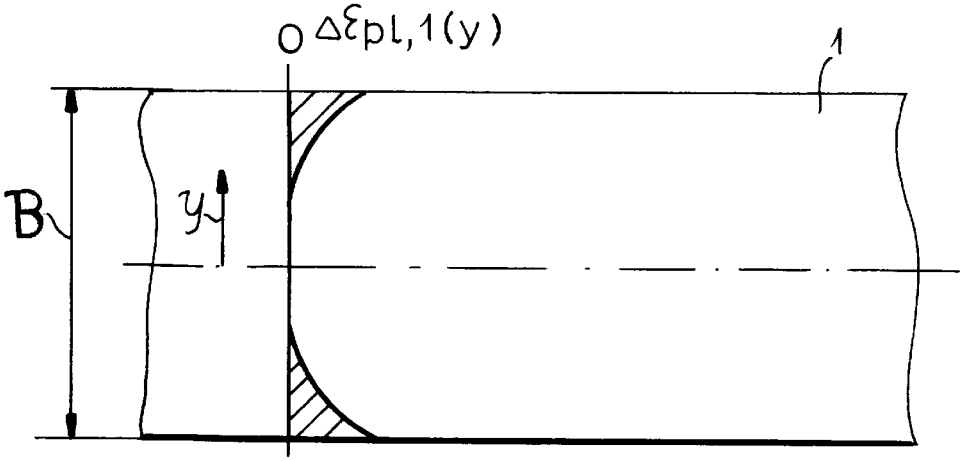
Figure 6:
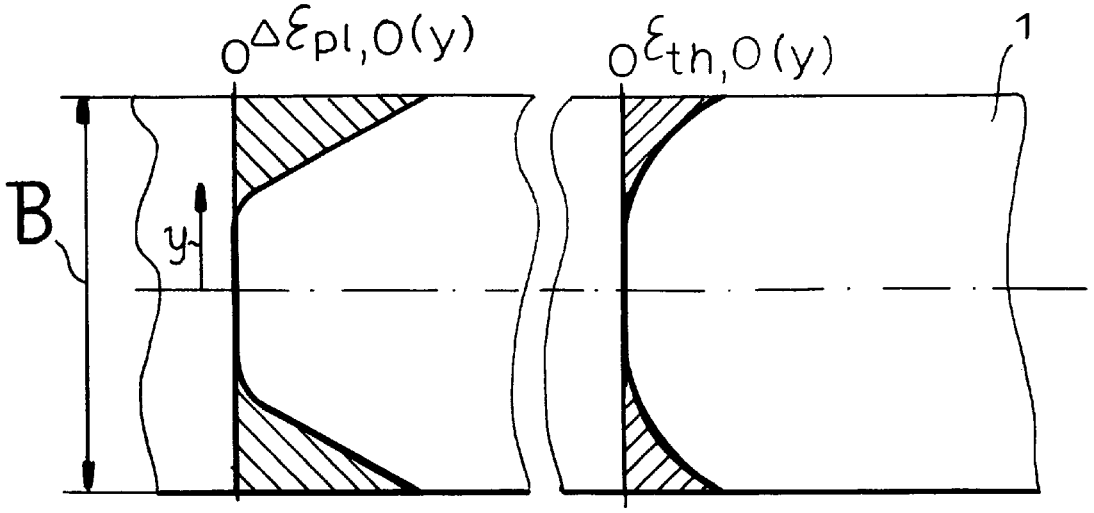
FIGS. 6 and 7 are graphic representations of the yield distribution in a metal strip in which the temperature profile of the strip varies across the strip width prior to rolling.
Figure 7:
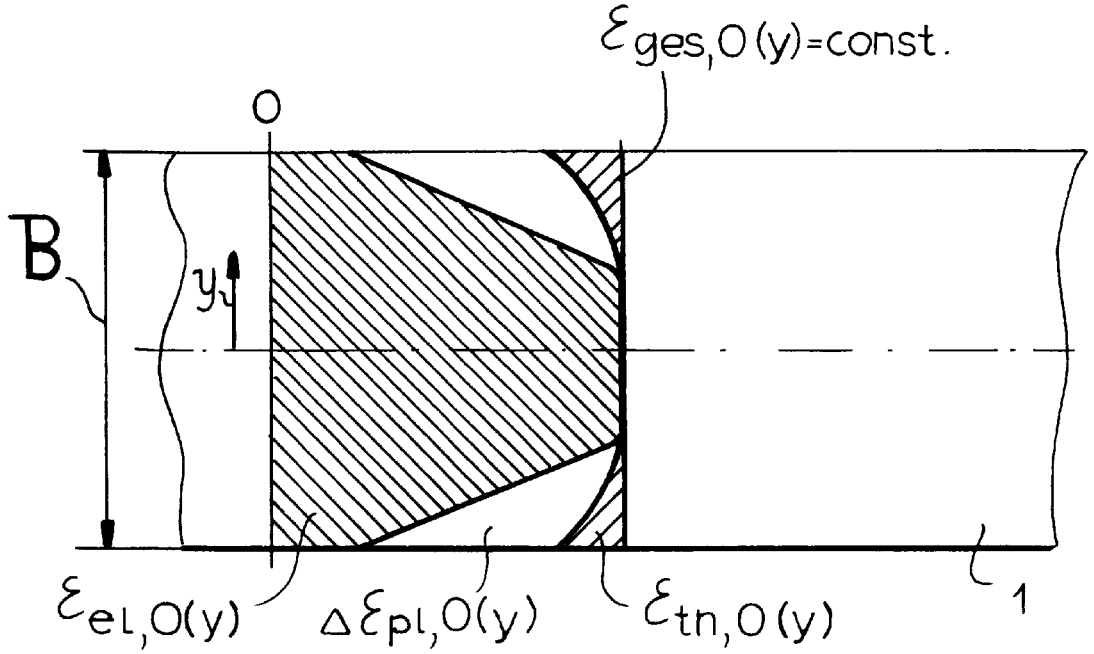

This can be seen especially from a comparison of FIGS. 2 and 5. The result is a reduction in the edge waviness as a consequence of the dressing. It should be understood, however, that the edge waviness is not completely eliminated. Complete elimination of the edge waviness is not possible because the distribution of the dressing degree $\epsilon_D(y)$ by mechanical means is not fully optional. In practice the range of adjustment of the flatness producing system is fully utilized however, in the example which has been given.

FIGS. 6 to 9 show the effect of the invention. From FIG. 6, in the left-hand region it is possible to see the plastic yield $\Delta\epsilon_{p1.0}(y)$ of the metal strip to be flattened. In this strip by zone-wise heating with a temperature profile variable across the width, it is possible to obtain the thermal yield profile $\epsilon_{th.0}(y)$ which has been illustrated in the right-hand region of FIG. 6. As a consequence of the heating of the metal strip predominantly in the edge regions, the tensile stress $\sigma_z$ in the metal strip and the degree of dressing $\epsilon_D$. It will immediately be apparent that the degree of dressing increases linearly with increasing tensile stress $\sigma_z$ and for a constant rolling force $F_W$.

Figure 8:
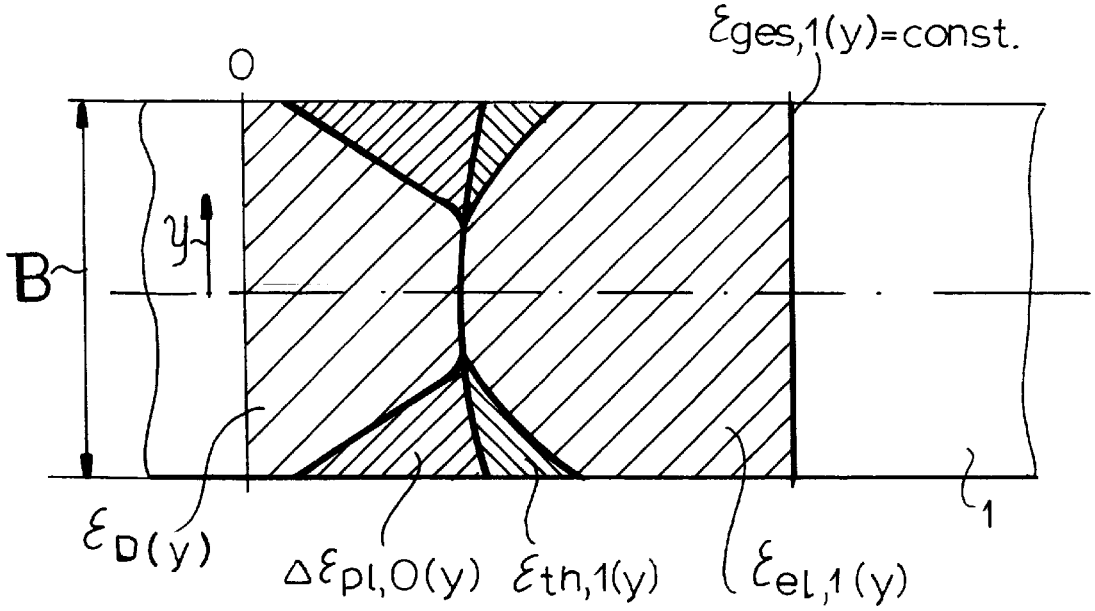
FIGS. 8 and 9 show the elongation or yield distribution across the strip after rolling.

Correspondingly, in the heated edge regions of the strip the degree of dressing $\epsilon_D$ is reduced and the new distribution of the dressing degree $\epsilon_D(y)$ corresponding to the new tensile stress distribution has been shown in FIG. 8 together with the original plastic yield $\Delta\epsilon_{p1.0}(y)$ and the new elastic yield. The resulting plastic yield $\Delta\epsilon_{p1.0}(y)$ resulting from the dressing rolling operation is again the sum of the original plastic yield $\Delta\epsilon_{e1.1}(y)$ and the degree of dressing $\epsilon_D(y)$.

Figure 9:
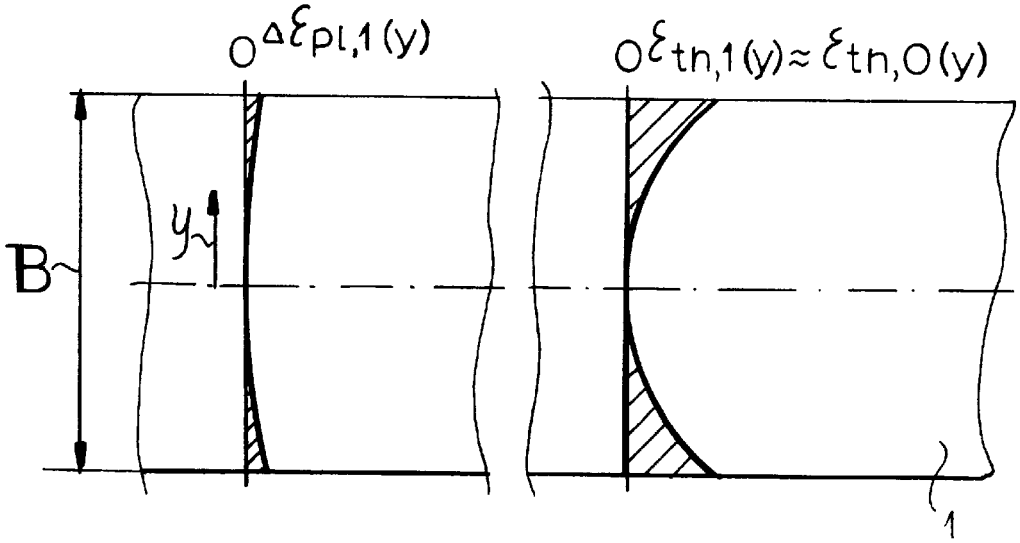
Figure 10:
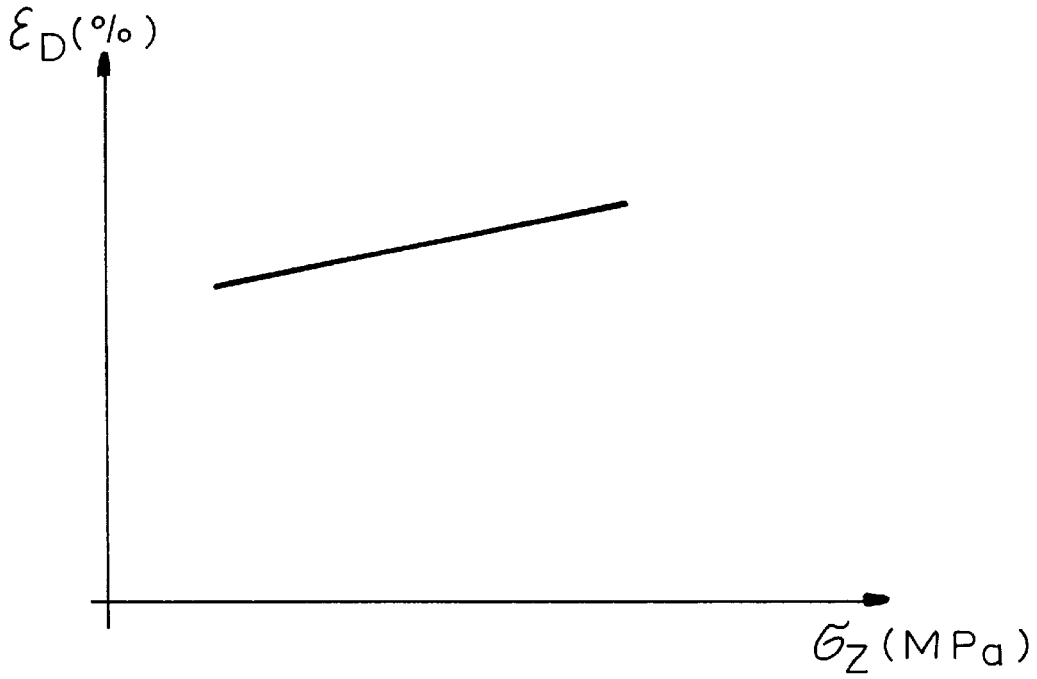
FIG. 10 is a graph plotting the relationship between the degree of dressing and the tension for a constant rolling force.

FIG. 9, especially, shows that the plastic yield $\Delta\epsilon_{e1.0}(y)$ can be further reduced in the edge regions so that the edge waviness is close to completely eliminated. The thermal yield $\epsilon_{th.0}(y)$ after the rolling corresponds to the thermal yield $\epsilon_{th.0}(y)$ prior to rolling.

Figure 11:
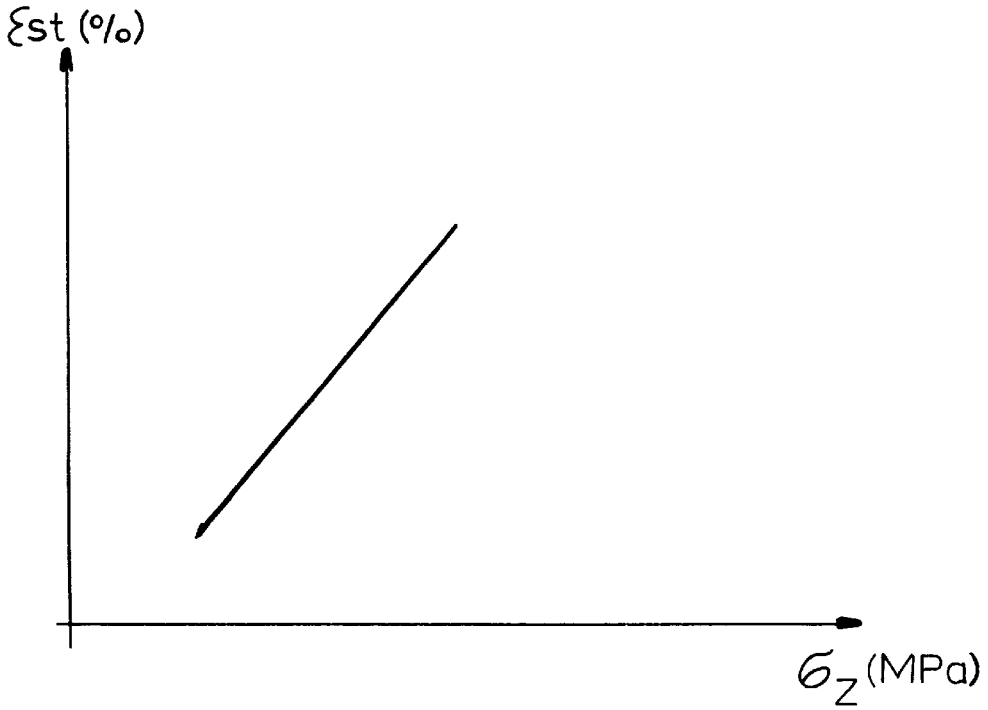
FIG. 11 is a graph plotting the dependency of the degree of stretch upon the tension for a stretch leveling or tension leveling system.

Finally, from FIG. 11 it will be apparent that not only is the degree of dressing $\epsilon_D$ dependent upon the tensile stress $\sigma_z$ but also the degree of stretch $\epsilon_{st}$ is so dependent in stretch bend leveling or tension leveling so that the aforementioned conditions are applicable to both leveling and stretching as well as to the dressing rolling of the strip under tension.

The quantitative demonstration that the method of the invention can theoretically completely eliminate each waviness is presented below. The edge waviness with a constant strip temperature after rolling of 20 I units is assumed as the starting point. The mean tensile stress $\overline{\sigma}_z$ amounts to 80 MPa. The dependency of the degree of dressing $\epsilon_D$ upon the tensile stress $\sigma_z$ is 0.1% per MPa. The modulus of elasticity E of the metal strip amounts to 200,000 MPa. The thermal yield of the metal strip $\Delta\epsilon_{th}=10^{-5}/°$ C. If the edge strips are heated by about $\Delta\epsilon_{th}=5°$ C., the tensile stress $\sigma_z$ in the edge strips is reduced relative to that at the center of the strip by the heating by $\sigma_z=\Delta\epsilon_{th}\times E=5\times10^{-5}\times200{,}000$ MPa=10 MPa. Correspondingly the degree of dressing $\epsilon_D$ edge of the metal strip is reduced by 0.02%. This corresponds to a value of $20\times10^{-5}$ and thus 20 I units by comparison to the center of the strip. This means that the waviness at each region of the metal strip is theoretically completely eliminated. Of course it should be noted that the thickness of the metal strip entering the rolling gap is also increased by about a factor of $5\times10^{-5}$ so that with a constant rolling gap geometry a slightly higher dressing degree is effected in the edge regions. This effect is, however, negligibly small so that with the process according to the invention, waviness or camber in the edge regions is practically completely eliminated.

We claim:

1. A method of flattening metal strip to produce a product with limited waviness and camber, said method comprising the steps of:

(a) applying tension to metal strip over a length thereof during travel of the metal strip along a processing line;

(b) subjecting said metal strip over said length and while under said tension to at least one plastic deformation operation selected from rolling, leveling and/or stretching with a degree of plastic deformation varying across a width of the metal strip;

(c) subjecting said metal strip within said length to zone-wise selective temperature modification at respective longitudinal zones across said width of the strip to establish a temperature distribution in said strip across said width and influence a tension distribution thereacross; and (d) adjusting said tension distribution by controlling said temperature distribution to maximize a degree of planarity imparted to said strip, said temperature distribution being established in step (c) subsequent to said plastic deformation operation.

2. A method of flattening metal strip to produce a product with limited waviness and camber, said method comprising the steps of:

(a) applying tension to metal strip over a length thereof during travel of the metal strip along a processing line;

(b) subjecting said metal strip over said length and while under said tension to at least one plastic deformation operation selected from rolling, leveling and/or stretching with a degree of plastic deformation varying across a width of the metal strip;

(c) subjecting said metal strip within said length to zone-wise selective temperature modification at respective longitudinal zones across said width of the strip to establish a temperature distribution in said strip across said width and influence a tension distribution thereacross; and (d) adjusting said tension distribution by controlling said temperature distribution to maximize a degree of planarity imparted to said strip, said temperature distribution being established in step (c) prior to a coiling of the strip and subsequent to said plastic deformation operation.

3. A method of flattening metal strip to produce a product with limited waviness and camber, said method comprising the steps of:

(a) applying tension to metal strip over a length thereof during travel of the metal strip along a processing line;

(b) subjecting said metal strip over said length and while under said tension to at least one plastic deformation operation selected from rolling, leveling and/or stretching with a degree of plastic deformation varying across a width of the metal strip;

(c) subjecting said metal strip within said length to zone-wise selective temperature modification at respective longitudinal zones across said width of the strip to establish a temperature distribution in said strip across said width and influence a tension distribution thereacross; and (d) adjusting said tension distribution by controlling said temperature distribution to maximize a degree of planarity imparted to said strip, temperatures of said strip being measured across said width upstream and downstream of said plastic deformation operation, said temperature distribution being set and controlled based upon the measurements, the temperature measurements being made by traversing a temperature measuring instrument across said width of the metal strip.

4. A method of flattening metal strip to produce a product with limited waviness and camber, said method comprising the steps of:

(a) applying tension to metal strip over a length thereof during travel of the metal strip along a processing line;

(b) subjecting said metal strip over said length and while under said tension to at least one plastic deformation operation selected from rolling, leveling and/or stretching with a degree of plastic deformation varying across a width of the metal strip;

(c) subjecting said metal strip within said length to zone-wise selective temperature modification at respective longitudinal zones across said width of the strip to establish a temperature distribution in said strip across said width and influence a tension distribution thereacross; and (d) adjusting said tension distribution by controlling said temperature distribution to maximize a degree of planarity imparted to said strip, temperatures of said strip being measured across said width upstream and downstream of said plastic deformation operation, said temperature distribution being set and controlled based upon the measurements, at least one of the temperature measurements being effected for set point/actual value control of planarity regulation at a location close to a planarity measuring location within said length, the planarity being measured by rollers engaging said strip and determining effective length of respective longitudinal zones thereof.

5. The method defined in claim 4 wherein the temperature measurements are made by traversing a temperature measuring instrument across said width of the metal strip.

6. A method of flattening metal strip to produce a product with limited waviness and camber, said method comprising the steps of:

(a) applying tension to metal strip over a length thereof during travel of the metal strip along a processing line;

(b) subjecting said metal strip over said length and while under said tension to at least one plastic deformation operation selected from rolling, leveling and/or stretching with a degree of plastic deformation varying across a width of the metal strip;

(c) subjecting said metal strip within said length to zone-wise selective temperature modification at respective longitudinal zones across said width of the strip to establish a temperature distribution in said strip across said width and influence a tension distribution thereacross; and (d) adjusting said tension distribution by controlling said temperature distribution to maximize a degree of planarity imparted to said strip, temperatures of said strip being measured across said width upstream and downstream of said plastic deformation operation and said temperature distribution being set and controlled based upon the measurements, at least one of the temperature measurements being effected for setpoint/actual value control of planarity regulation at a location close to a planarity measuring location within said length, the planarity of said strip being measured by contactless measurement.

7. A method of flattening metal strip to produce a product with limited waviness and camber, said method comprising the steps of:

(a) applying tension to metal strip over a length thereof during travel of the metal strip along a processing line;

(b) subjecting said metal strip over said length and while under said tension to at least one plastic deformation operation selected from rolling, leveling and/or stretching with a degree of plastic deformation varying across a width of the metal strip;

(c) subjecting said metal strip within said length to zone-wise selective temperature modification at respective longitudinal zones across said width of the strip to establish a temperature distribution in said strip across said width and influence a tension distribution thereacross; and (d) adjusting said tension distribution by controlling said temperature distribution to maximize a degree of planarity imparted to said strip, a uniform temperature profile being imparted to said strip by zone-wise heating and cooling thereof subsequent to said plastic deformation operation.

* * * * *